US006006672A

United States Patent [19]

Newfarmer et al.

[11] Patent Number: 6,006,672

[45] Date of Patent: Dec. 28, 1999

[54] BOAT REVERSING WATERWAY

[75] Inventors: Don Newfarmer, Santa Clara, Calif.; Jeremy L. Pendelton, Sr., Contoocook, N.H.

[73] Assignee: O.D. Hopkins Associates, Incorporated, Contoocook, N.H.

[21] Appl. No.: 09/018,250

[22] Filed: Feb. 3, 1998

[51] Int. Cl.[6] ..... A63G 1/00

[52] U.S. Cl. ..... 104/53; 104/23.2; 104/59; 104/73

[58] Field of Search ..... 104/23.2, 59, 70, 104/72, 73, 53

[56] References Cited

U.S. PATENT DOCUMENTS 3,807,806 4/1974 Takahashi ..... 104/73
4,543,886 10/1985 Spieldiener et al. ..... 104/53

*Primary Examiner*—Mark T. Le
*Assistant Examiner*—Robert J. McCarry, Jr.
*Attorney, Agent, or Firm*—Pollock, Vande Sande & Amernick, R.L.L.P.

[57] ABSTRACT

A waterway for a boat amusement ride comprising first and second water troughs connected by a basin such that water flowing in the waterway changes direction through a sharp turning angle in flowing from the basin inlet to the basin outlet. Vanes in the basin cause a boat buoyantly supported and propelled by the water flow to move laterally such that the end of the boat first entering the basin leaves the basin behind the end of the boat last entering the basin, the orientation of the boat thereby being reversed as it passes through the basin. Optional elements for moving the boat laterally include water jets directed by nozzles on sidewalls of the basin and a rotating pushing member for engaging the last entering boat end. The pushing member may also be actuated laterally while abutting the last entering boat end.

25 Claims, 5 Drawing Sheets

BOAT REVERSING WATERWAY

TECHNICAL FIELD

The present invention relates generally to amusement rides, and more particularly to an amusement ride employing passenger-carrying boats as the ride vehicle.

BACKGROUND OF THE INVENTION

There are conventional boat amusement rides that utilize a continuous waterway having a fixed and predetermined course and along which a plurality of passenger-carrying boats are buoyantly supported and propelled by water flowing in the waterway. Passengers generally board and leave the boats at a loading station, and the boats are stopped at the loading station for this purpose.

The water flow is typically provided by pumping water along the channels or troughs forming the waterway. To increase the excitement of the ride, it is also desirable to reverse the front and back orientation of the boat. Past efforts for reversing the orientation of the boat have involved turntables and similar mechanical means that have proven to be slow and inefficient. Such inefficiency decreases the number of passengers per unit time that can be handled by the ride and therefore increases the waiting time. Many passengers may forego the pleasure of a ride rather than wait in a long line to board a boat. Since ride capacity is a determinant of economic feasibility of the ride system, any increase is desirable.

SUMMARY OF THE INVENTION

A principal object of the present invention is to provide a boat amusement ride utilizing a continuous waterway having reversing basins between consecutive troughs of the waterway, wherein the direction of the water flow is changed through a turning angle in flowing from the outlet of the upstream trough to the inlet of the downstream trough, and wherein water currents provided in the basin cause the boat to move laterally such that the end of the boat first entering the basin via the trough outlet is the last to leave the basin via the trough inlet, the respective ends of the boat thereby being reversed as the boat passes through the basin.

Another object of the invention is to provide a boat amusement ride in which the respective ends of the boat are reversed at each intersection between consecutively connected water troughs and in which such reversal is achieved with a minimum of mechanical components.

A further object of the invention is to provide a boat amusement ride of the type described which is capable of handling a maximum number of passengers in a minimum amount of time.

Yet another object of the invention is to provide a boat amusement ride that includes a continuous waterway having basins between consecutive troughs that define a sharp turn for the water flow, and that cause a reversal of the respective ends of a boat passing through the same.

According to the present invention, there is provided a boat amusement ride comprising a plurality of waterway segments in the form of consecutive troughs each interconnected to the other by a basin providing water currents that move each boat laterally from the outlet of an upstream trough to the inlet of a downstream trough such that the respective ends of the boat are reversed as the boat passes through the basin. The water currents may be created by vanes along the bottom of the basin or by water nozzles along the sides of the basin or by both such vanes and such water nozzles. In addition, a powered pushing member may be provided at the base of the basin to aid the lateral movement of the boat and/or to ensure that the boat does not become lodged in the intersection due to misalignment.

BRIEF DESCRIPTION OF THE DRAWINGS

The structure, operation, objects and advantages of the present invention may be further understood by reference to the detailed description below taken in conjunction with the accompanying drawings in which.

DETAILED DESCRIPTION OF PREFERRED EMBODIMENTS OF THE INVENTION

Figure 1:
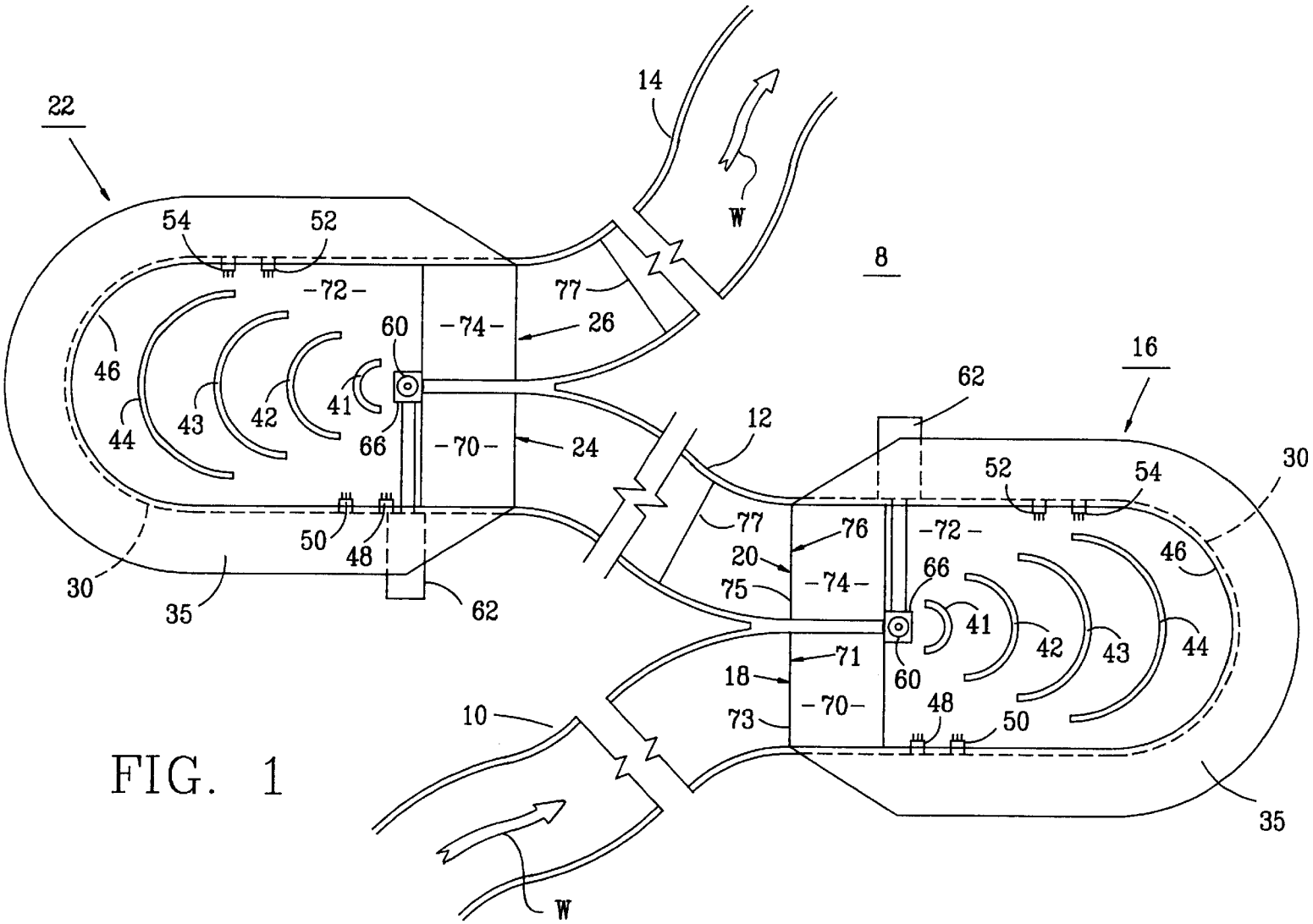
FIG. 1 is a top plan view of the waterway of the invention in which a plurality of troughs are interconnected by a plurality of reversing basins.
Figure 3:
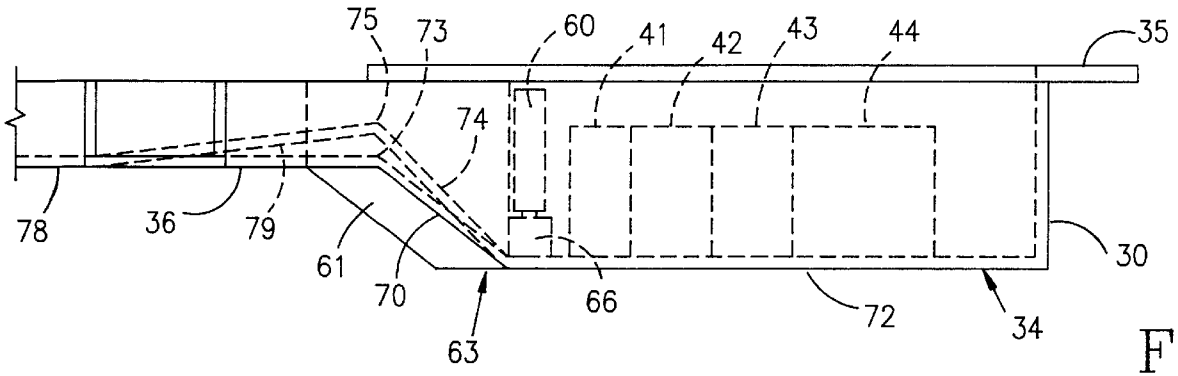
FIG. 3 is a side elevational view of the reversing basin of the invention.

Referring to FIG. 1 of the drawings, there is shown a passenger-carrying boat amusement ride having a waterway 8 comprised of a plurality of consecutive troughs 10, 12 and 14 and interconnecting basins 16 and 22, which form intersections between adjacent troughs. Basin 16 connects the outlet 18 of the trough 10 to the inlet 20 of the trough 12, and basin 22 connects the outlet 24 of trough 12 to the inlet 26 of trough 14. Since basins 16 and 22 are mirror images of each other with basin 16 turning the water flow W counterclockwise and basin 22 turning the water flow W clockwise, only the basin 16 will be described in detail.

Referring now to FIGS. 2–6, basin 16 is defined by a curved end wall 30, opposing sidewalls 32 and 33 and a bottom wall 34. The basin 16 may be substantially deeper than either of the troughs 10 and 12, which have respective bottom walls 36 and 38. For example, the nominal depth of the basin 16 may be 6 feet whereas the nominal depth of the troughs 10 and 12 may be 2 feet, depending on the water velocity desired. At the top of basin walls 30, 32 and 33 is a ledge or shelf 35, which may serve as a platform for repair and maintenance personnel and/or a support for special effects equipment.

Figure 2:
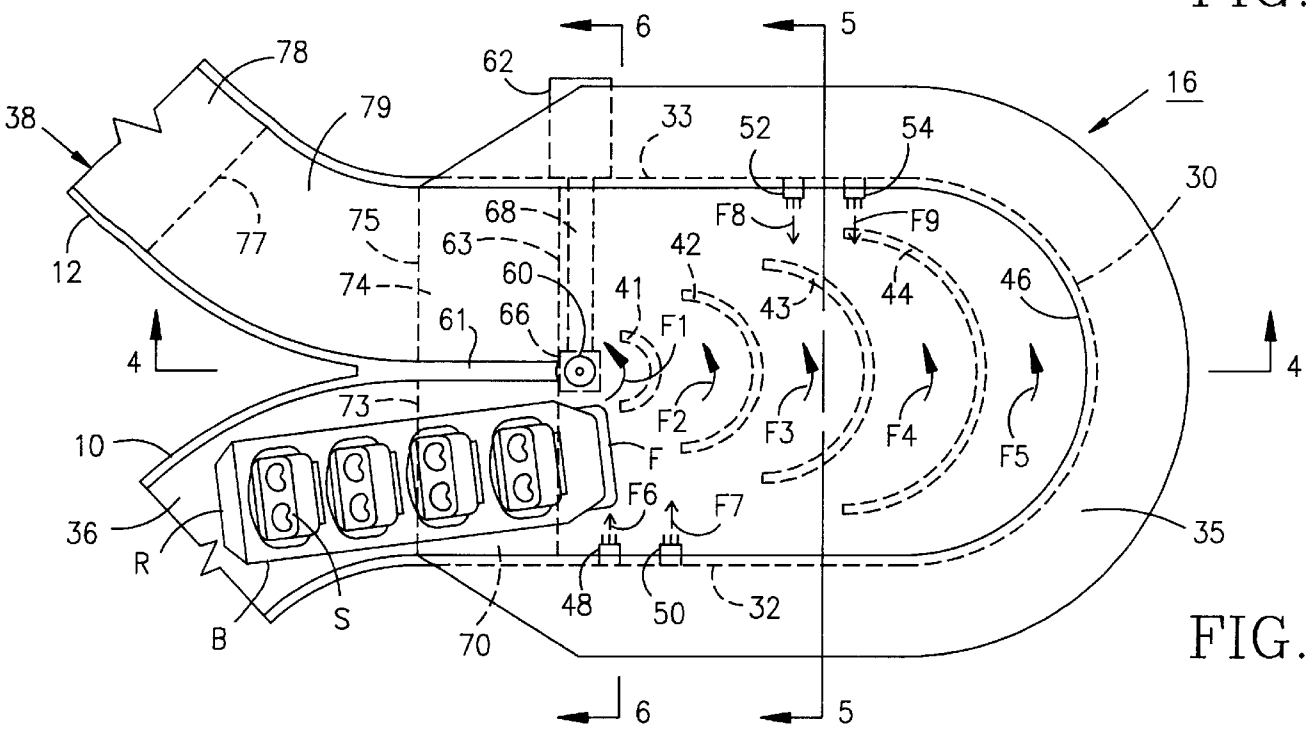
FIG. 2 is a top plan view of the reversing basin of the present invention.
Figure 6:
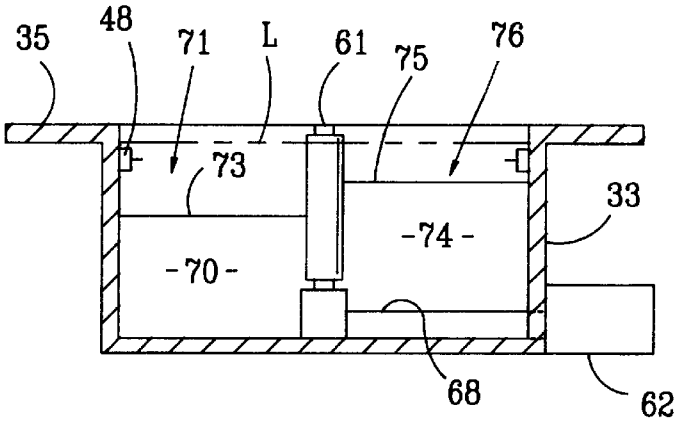
FIG. 6 is an end elevational view in section taken along lines 6—6 of FIG. 2.
Figure 5:
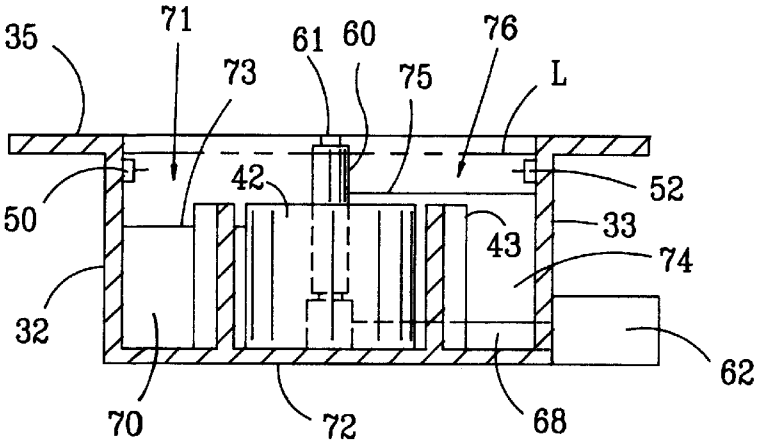
FIG. 5 is an end elevational view in section taken along lines 5—5 of FIG. 2.
Figure 4:
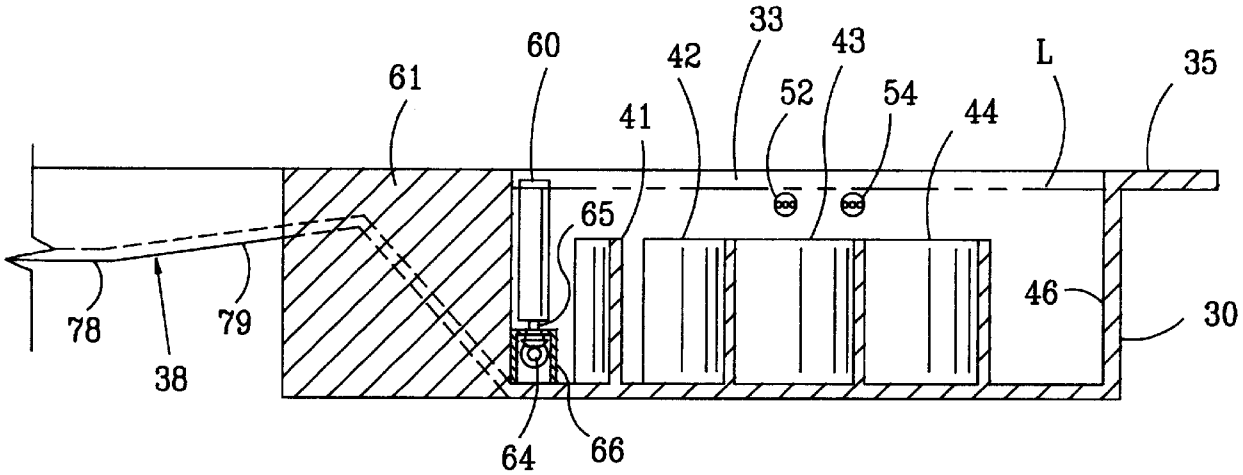
FIG. 4 is a side elevational view in section taken along lines 4—4 of FIG. 2.

Mounted upon the bottom 34 of basin 16 are a plurality of water turning vanes 41, 42, 43 and 44, each having a curvilinear shape as illustrated in FIGS. 1 and 2. In addition, the basin sidewalls 32 and 33 are connected by the curvilinear end wall 30, the inner surface 46 of which also serves as a water turning vane.

Figure 7:
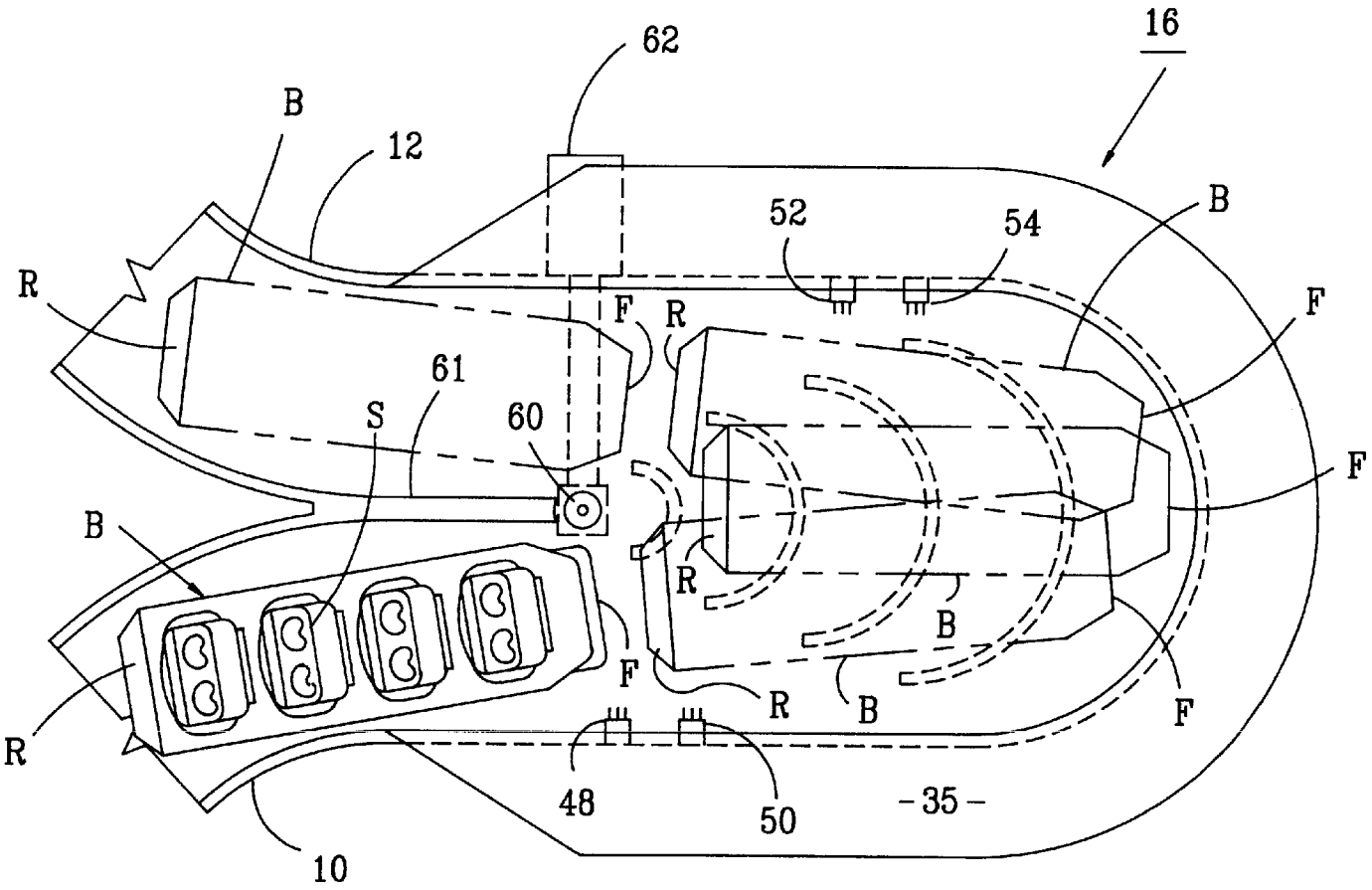
FIG. 7 is a top plan view of the reversing basin illustrating several positions of a boat as it traverses the basin; and, FIG. 8 is a top plan view of a modification of the reversing basin of the invention.

Each boat B of a plurality of boats may have a plurality of dual passenger seats S. When a boat B has entered the basin 16, the water flowing between the water turning vanes exerts a plurality of lateral forces against the underside of the boat as represented by the arrows F1, F2, F3, F4 and F5 in FIG. 2. These forces cause the boat B to move laterally as shown in FIG. 7, so that the front end F of the boat entering the basin first through trough outlet 18 becomes the boat end leaving the basin last through trough inlet 20, and the rear end R of the boat entering last through trough outlet 18 becomes the boat end entering first into trough inlet 20. In other words, the end of the boat facing forward in trough 12 is reversed from that facing forward in trough 10. Relative to passengers facing front end F, they are facing forward in trough 10 and backward in trough 12. Optionally, the lateral forces produced by vanes 41–44 may be supplemented by lateral forces F6 and F7 resulting from lateral water currents produced by jets of water issuing from water nozzles 48 and 50 mounted in the basin sidewall 32 above the level of the uppermost edges of vanes 41–44 as may be seen best in FIGS. 4–6. Other optional elements for maintaining proper orientation of the boats B as they traverse basins 16 and 22 are water nozzles 52 and 54 for producing water jets that provide forces F8 and F9 in a direction opposite to the forces F6 and F7. However, the water nozzles 52 and 54 are offset toward the basin end wall 30 relative to water nozzles 48 and 50 such that the forces F8 and F9 are applied to a portion of the boat that tends to rotate the boat about its center of gravity in the same direction as forces F6 and F7, i.e., in a clockwise direction in basin 16 and in a counterclockwise direction in the basin 22. Thus, the water nozzles 48, 50, 52 and 54 help to ensure the boat reversing action provided by the respective basins.

A powered roller 60 driven by a motor 62 may also be optionally provided adjacent to the inner end of a dividing wall 61 extending inward toward the base 63 of the basin 16 to help maintain proper orientation of the boats B as they traverse the basin. Roller 60 is elongated and oriented for rotation about a vertical axis (FIGS. 4–6), and rotates as viewed in plan (FIGS. 1–2) in a counterclockwise direction in basin 16 and in a clockwise direction in basin 22. Thus, when the roller 60 is engaged by the rear end R of the boat last entering the basin 16, the boat rear end R is urged toward the downstream trough 12 to aid in the reversing action and to help prevent the boat from becoming lodged in the basin because of an improper orientation. In basin 22, the roller 60 engages the front end F of the boat B for the same purpose since here the front end F is the part of the boat last entering the basin 22.

The motor 62 may be mounted on the basin sidewall 33 for ready access as shown in the drawings. In this position, the motor shaft 64 is rotatably connected to the roller shaft 65 via a gear box 66. The motor shaft 64 may be housed in a water tight enclosure 68 resting on the bottom wall 34 and having an aerodynamic cross-sectional shape to minimize water turbulence.

The motor 62 may also be mounted above the roller 60 on a bearing assembly (not shown) supported by the dividing wall 61, or under the bottom wall 34 of the basin, so that its shaft is in line with the rotational axis of the roller 60. Such a vertical mounting of the motor may instead be offset horizontally from the roller and connected to its shaft via a conventional drive belt and pulley arrangement.

As may be seen best in FIGS. 3 to 6, the bottom wall 34 of basin 30 has a main section 72 that is substantially below the respective bottom walls 36 and 38 of troughs 10 and 12. To minimize turbulence of the water entering and leaving the basin 16, the basin has an inlet bottom section 70 slanting downward from trough bottom 36 to the main bottom wall section 72, thereby forming an inlet apex 73 at the basin inlet 71. Similarly, an outlet bottom wall section 74 is slanted upwardly from the main bottom wall section 72 to the bottom wall 38 of downstream trough 12, thereby forming an outlet apex 75 at the basin outlet 76. The water level in the basin 30 is represented by the broken line L in FIGS. 4–6.

The outlet apex 75 preferably is at a substantially higher elevation than the inlet apex 73, such that the cross-sectional area of the water flow through the basin outlet 76 is substantially less than the cross-sectional area of the water flow through the basin inlet 71. This difference in elevation is preferably in the range of about 6 inches to about 18 inches, more preferably about 12 inches. Because of this difference in elevation, the velocity of the water flow entering the inlet 20 of trough 12 is substantially greater than the velocity of the water flow leaving the outlet 18 of trough 10. The velocity of the water exiting the basin 16 is therefore accelerated and thereby accelerates the velocity of the boat as it enters into and begins to travel downstream in trough 12.

Preferably, the bottom wall 36 of trough 10 and the main bottom wall section 72 of basin 16 are substantially horizontal. It is also preferred that the main run 78 of bottom wall 38 of trough 12 is also substantially horizontal. However, for a relatively short distance downstream of the outlet apex 75, a slanted segment 79 of the bottom wall 38 has a gradual downward slope while this portion of the bottom wall is being faired from outlet apex 75 down into the main run 78 of trough 12 (FIG. 3) to make the cross-sectional area of this main run substantially the same as the cross-sectional area of the corresponding main run of trough 10. The end of the sloped fairing is represented by line 77 in the drawings. The gradual downward slope of the trough segment between outlet apex 75 and line 77 may extend for a relatively long horizontal distance, such as about 12 to 24 feet, which is substantially longer than the sloped basin sections 70 and 74, which preferably extend for a horizontal distance of about 6 to 8 feet.

In the embodiment of FIGS. 1–7, the water flow changes direction through a turning angle of substantially 180° as it passes through the basin 16 from trough outlet 18 to trough inlet 20. However, smaller water turning angles are also contemplated as illustrated by the turning angle A in FIG. 8, which shows a modified basin 16' interconnecting an upstream trough 10' and a downstream trough 12', and having water flow directing vanes 41', 42', 43' and 44', and water jet forming nozzles 48', 50', 52' and 54'

Figure 8:
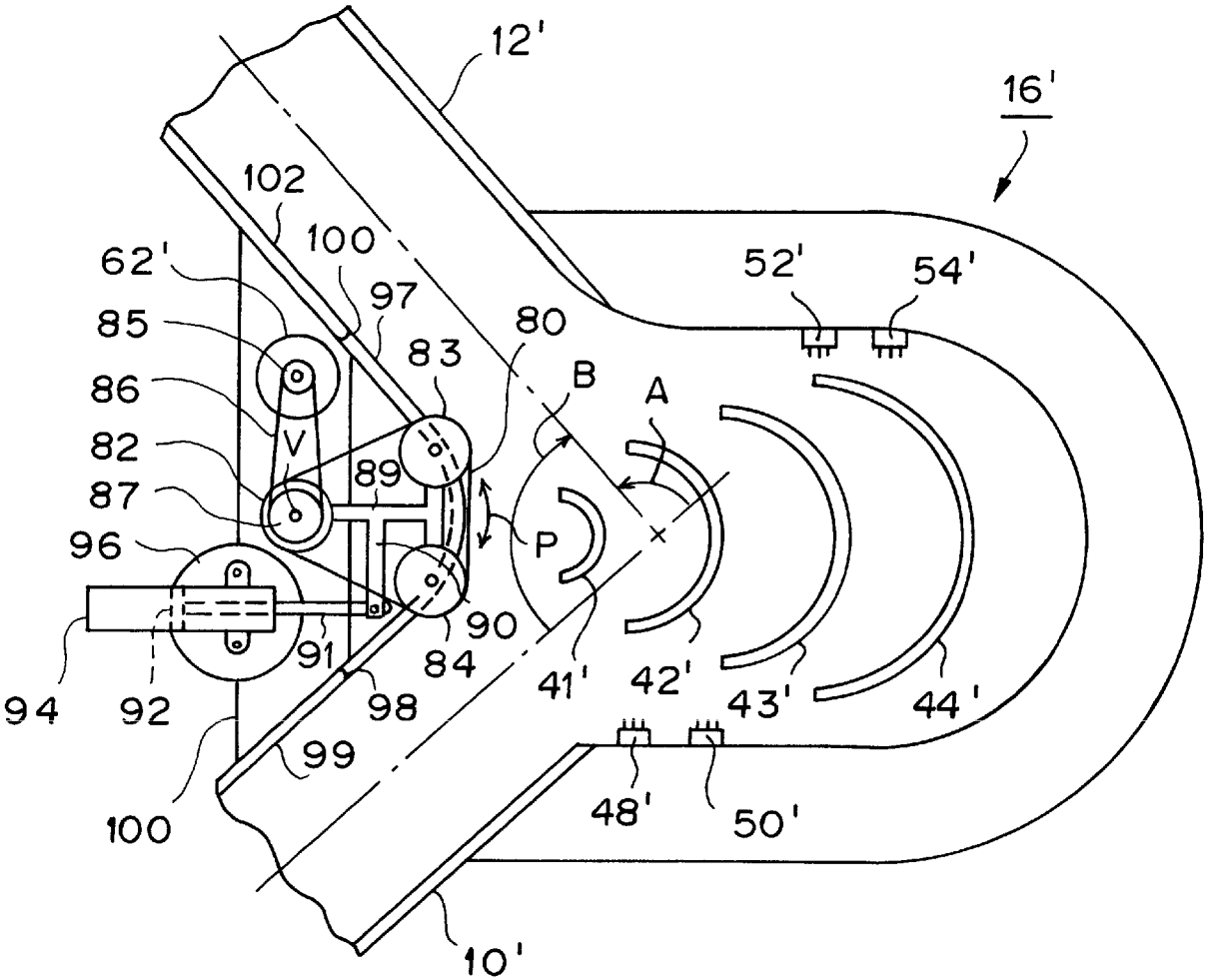

In the embodiment of FIG. 8, the powered roller 60 has been replaced by a wide endless belt 80 that moves horizontally in a counterclockwise direction around a driving roller 82 and two idler rollers 83 and 84, each of which is mounted for rotation about a vertical axis. Driving roller 82 is driven in rotation around its vertical axis by a motor 62' having a motor shaft connected to the roller shaft via a motor pulley 85, a drive belt 86 and a roller pulley 87. The belt 80 engages the abutting end of the boat for a longer time than would be provided by a single roller 60. This belt pushes the abutting boat end from a position adjacent to the outlet of trough 10' to a position adjacent to the inlet of trough 12' to facilitate pivoting the boat axis through the reversing angle B. As can be seen in FIG. 8, the boat reversing angle B increases as the water turning angle A decreases. The turning angle A may be in the range of about 90° to about 180° , preferable at least about 120° or larger, more preferable at least about 150° , and most preferable about 180°.

Although the belt 80 may be maintained at a fixed position relative to the upstanding sidewalls of the troughs 10' and 12', it also may be mounted for pivotal movement between a stepped end portion 98 of the upstanding sidewall 99 of entering trough 10' and a stepped end portion 100 of an upstanding sidewall 102 of exiting trough 12'. This pivotal movement passes over a sidewall portion 97 of reduced height connecting the sidewalls 99 and 102, and is indicated by the double ended arrow P as shown in FIG. 8. In other words, the mechanism for rotatably supporting the belt 80 may be pivoted over the sidewall portion 97 from a boat entering position wherein idler roller 84 is adjacent the stepped wall end 98 to a boat exiting position wherein idler roller 83 is adjacent to the stepped wall end 100. This pivotal movement is such that the belt 80 stays in contact with an abutting portion of the last entering boat end to assist in pivoting the longitudinal axis of the boat from its entering position to its exiting position as the orientation of the boat is reversed in the basin 16'.

The rollers 82, 83, and 84 are elongated to accommodate the vertically extending width of belt 80 and are rotatably mounted on a T-shaped frame 89 having a rigid laterally extending lever 90. The distal end of lever 90 is pivotally connected to the distal end of a piston rod 91, which is actuated by a piston 92 arranged for back and forth reciprocating movement in response to pneumatic or hydraulic pressure differentials within a cylinder 94. Frame 89 is mounted on a platform 100 for pivotal movement about a vertical axis V, which may be the same as the rotational axis of drive roller 82. To accommodate this pivotal movement of frame 89, cylinder 94 is pivotally mounted on the fixed platform 100 by an intermediate rotary platform 96. The belt 80 is driven in counterclockwise rotation relative to the basin 16' by the motor 62' throughout the pivotal movement from its initial rest position adjacent to wall end 98 to its fully pivoted position adjacent to wall end 100.

While the invention has been described above in conjunction with the preferred embodiments thereof, many other changes, modifications, alterations and variations will become apparent to those skilled in the art when they learn of the invention. Thus, the respective water troughs and the basins at the respective intersections therebetween may be made of concrete and rest on the ground, or they being made of steel and elevated above ground level on stands or other support structures. In addition, while the main runs of the troughs are shown as being substantially horizontal, they may be slanted downward from inlet to outlet at various angles to form a chute for accelerating the water flow and the boats propelled thereby. Accordingly, the preferred embodiments of the invention set forth above are intended to be illustrative, not limiting, and various changes may be made without departing from the spirit and scope of the invention as defined by the claims set forth below.

What is claimed is:

1. A waterway for reversing orientation of a boat conveyed thereby, said waterway comprising:

first and second troughs each adapted to contain a flow of water for buoyantly supporting and propelling the boat;

a basin for containing a portion of said flowing water and connecting an outlet of said first trough to an inlet of said second trough, said basin being adapted to cause said water flow to change direction through a turning angle in flowing from said trough outlet to said trough inlet; and means for providing water currents in said basin to cause the boat to move laterally such that a first end of the boat enters the basin via said first trough outlet ahead of a second end of the boat, and the second boat end leaves the basin via said second trough inlet ahead of the first boat end, such that said first boat end is facing forward in said first trough and said second boat end is facing forward in said second trough.

2. A waterway according to claim 1, wherein said turning angle is in the range of about 90° to about 180°.

3. A waterway according to claim 1, wherein said turning angle is at least about 120°.

4. A waterway according to claim 1, wherein said turning angle is at least about 150°.

5. A waterway according to claim 1, wherein the boat is adapted to carry at least one passenger.

6. A waterway according to claim 1, wherein the boat is adapted to carry a plurality of passengers.

7. A waterway according to claim 1, wherein said current means comprises a curved end wall of said basin and at least one curved vane spaced inwardly from said basin end wall for providing said water currents by directing portions of said water flow as it passes through said basin from said trough outlet to said trough inlet.

8. A waterway according to claim 7, wherein said current means further comprises a plurality of said curved vanes spaced inwardly at different distances from said basin end wall.

9. A waterway according to claim 7 further comprising a pushing member driven by a motor and arranged for engaging said boat to push the second end thereof laterally away from a sidewall of said basin adjacent to said trough outlet and toward a sidewall of said basin adjacent said trough inlet.

10. A waterway according to claim 7, wherein said current means further comprises at least one nozzle mounted on a sidewall of said basin for ejecting a jet of water against the boat while it is in said basin.

11. A waterway according to claim 10 further comprising a pushing member driven by a motor and arranged for engaging said boat to push the second end thereof laterally away from a sidewall of said basin adjacent to said trough outlet and toward a sidewall of said basin adjacent said trough inlet.

12. A waterway according to claim 1, wherein said current means further comprises at least one nozzle mounted on a sidewall of said basin for ejecting a jet of water against the boat while it is in said basin.

13. A waterway according to claim 1 further comprising a pushing member driven by a motor and arranged for engaging said boat to push the second end thereof laterally away from a sidewall of said basin adjacent to said trough outlet and toward a sidewall of said basin adjacent said trough inlet.

14. A waterway according to claim 13, wherein said pushing member is a roller arranged for rotation about a substantially vertical axis.

15. A waterway according to claim 13, wherein said pushing member is an endless belt arranged to travel substantially horizontally in engagement with said second boat end.

16. A waterway according to claim 13, wherein said pushing member is arranged for lateral movement to remain in engagement with said second boat end during movement of said second boat end from a position adjacent to said trough outlet to a position adjacent to said trough inlet.

17. A waterway according to claim 1, wherein said basin comprises:

a main bottom section positioned below respective bottom portions of said first and second troughs, an inlet bottom section forming an inlet apex with the bottom portion of said first trough and slanting downward from said trough outlet to said main bottom section, and an outlet bottom section forming an outlet apex with the bottom portion of said second trough and slanting upward from said main bottom section to said trough inlet.

18. A waterway according to claim 17, wherein said outlet apex is at a substantially higher elevation than said inlet apex such that the cross-sectional area of the water flow through said trough inlet is substantially less than the cross-sectional area of the water flow through said trough outlet so that the velocity of the water flow leaving the basin through the inlet of said second trough is substantially greater than the velocity of the water flow entering the basin through the outlet of said first trough.

19. A waterway for reversing orientation of a boat conveyed thereby, said waterway comprising:

first and second troughs each adapted to contain a flow of water for buoyantly supporting and propelling the boat; and, a basin for containing a portion of said flowing water and connecting an outlet of said first trough to an inlet of said second trough;

said basin being adapted to cause said water flow to change direction through a turning angle in flowing from said trough outlet to said trough inlet, and said basin comprising a curved end wall and at least one curved vane spaced inwardly from said end wall for providing water currents in said basin to cause the boat to move laterally such that a first end of the boat enters the basin via said first trough outlet ahead of a second end of the boat, and the second boat end leaves the basin via said second trough inlet ahead of the first boat end, such that said first boat end is facing forward in said first trough and said second boat end is facing forward in said second trough.

20. A waterway according to claim 19, wherein said basin further comprises a plurality of said curved vanes spaced inwardly at different distances from said basin end wall.

21. A waterway according to claim 19, wherein said basin further comprises a pushing member driven by a motor and arranged for engaging said boat to push the second end thereof laterally away from a sidewall of said basin adjacent to said trough outlet and toward a sidewall of said basin adjacent said trough inlet.

22. A waterway according to claim 19, wherein said basin further comprises at least one nozzle mounted on a sidewall of said basin for ejecting a jet of water against the boat while it is in said basin.

23. A waterway according to claim 22, wherein said basin further comprises a pushing member driven by a motor and arranged for engaging said boat to push the second end thereof laterally away from a sidewall of said basin adjacent to said trough outlet and toward a sidewall of said basin adjacent said trough inlet.

24. A waterway according to claim 19, wherein said basin further comprises:

a main bottom section positioned below respective bottom portions of said first and second troughs, an inlet bottom section forming an inlet apex with the bottom portion of said first trough and slanting downward from said trough outlet to said main bottom section, and an outlet bottom section forming an outlet apex with the bottom portion of said second trough and slanting upward from said main bottom section to said trough inlet.

25. A waterway according to claim 24, wherein said outlet apex is at a substantially higher elevation than said inlet apex such that the cross-sectional area of the water flow through said trough inlet is substantially less than the cross-sectional area of the water flow through said trough outlet so that the velocity of the water flow leaving the basin through the inlet of said second trough is substantially greater than the velocity of the water flow entering the basin through the outlet of said first trough.

* * * * *